US008026454B2

(12) United States Patent
Grzan et al.

(10) Patent No.: US 8,026,454 B2
(45) Date of Patent: Sep. 27, 2011

(54) LINEAR PRESSURE SWITCH APPARATUS AND METHOD

(76) Inventors: John T. Grzan, Brentwood, NY (US); Matt Grzan, Brentwood, NY (US); Joseph L. Montalto, Ridge, NY (US)

( * ) Notice: Subject to any disclaimer, the term of this patent is extended or adjusted under 35 U.S.C. 154(b) by 0 days.

(21) Appl. No.: 12/642,628

(22) Filed: Dec. 18, 2009

(65) Prior Publication Data

US 2010/0096245 A1 Apr. 22, 2010

Related U.S. Application Data

(63) Continuation of application No. 11/983,349, filed on Nov. 8, 2007, now Pat. No. 7,659,485.

(51) Int. Cl.
*H01H 21/26* (2006.01)

(52) U.S. Cl. ..... 200/61.41; 200/61.44

(58) Field of Classification Search ..... 200/86 R, 200/86 A, 85 A, 512, 61.41–61.44
See application file for complete search history.

(56) References Cited

U.S. PATENT DOCUMENTS

| | | | | |
|---|---|---|---|---|
| 3,811,025 | A * | 5/1974 | Bach | 200/317 |
| 4,922,067 | A * | 5/1990 | West | 200/83 P |
| 2005/0061649 | A1 * | 3/2005 | Howie et al. | 200/512 |

* cited by examiner

*Primary Examiner* — Gary F. Paumen
(74) *Attorney, Agent, or Firm* — Harold G. Furlow, Esq.

(57) ABSTRACT

A linear pressure switch is described that has two conductors separated by strips of insulation. The conductors are resilient members that can vary in thickness and material along with the insulation to provide a range of switch sensitivities. The switch can include connectors and an attachment mechanism that facilitates the installation and removal the switch from a given application. In addition, the switch can ergonomically enhanced actuation. The switches can be stacked in layers and selectively have different sensitivities to provide a desired signal output for each switch in a given application. The switch can also include external coatings on the jacket which enhance the feel and resistance of the jacket to wear and misuse.

16 Claims, 5 Drawing Sheets

LINEAR PRESSURE SWITCH APPARATUS AND METHOD

CROSS-REFERENCE TO RELATED APPLICATIONS

This application is a continuation of and claims priority to patent application Ser. No. 11/983,349 filed Nov. 8, 2007 now U.S. Pat. No. 7,659,485.

FIELD OF THE INVENTION

The present invention relates to pressure activated linear switches and more specifically to improved pressure activated linear switch apparatuses that can be directly connected to an external surface, have ergonomic structures to facilitate activation and a range of external connector configurations.

BACKGROUND OF THE INVENTION

Linear switches have a broad range of applications that include mats that activate doors, electrical safety interrupts and automobile sensors. The problems associated with linear switches are well known and include those associated with coiling for transportation and storage as well as the ability to mass produce switches tailored for individual applications.

In particular, the tailoring of linear switches to individual applications can be a time consuming problem in which a section of linear switch is cut, spliced and hard wired into a circuit. This connection between the conductors of the switch and circuit can become an additional reliability problem beyond that of the switch itself. Further, the failure of the switch requires the removal and replacement of a hard wired portion of the circuit that is often further complicated by the use of a specialized channel or adhesive that attaches and fixes the switch to an external surface.

Linear switches are typically fixed in position against a substantially rigid surface in order to assure reliable activation. Specialized channels can fix linear switches in position and facilitate the activation of the switch, but these channels require additional fasteners to be installed and then a cumbersome and time consuming sliding integration of the linear switch and channel.

Another problem with linear switches is their lack of sufficient tactile sensation. Many common linear switches employed in channels, for example, have a raised backbone or ridge along the top longitudinal centerline of the switch that is made of the same dense polymer or rubber materials as the jacket. This raised backbone can facilitate switch actuation in many automated or industrial applications by providing a limited tactile sensation of the switch and direction for activating the switch, but locating and compressing the dense polymer or rubber materials along the narrow ridge can be difficult for many applications.

A linear pressure switch apparatus is needed that has an attachment mechanism for readily fixing into position, connectors for ease of placement and removal from a circuit and that can be actuated with a softer tactile sensation with improved ergonomic qualities. Further, a linear pressure switch apparatus is needed that can discriminate between a range of actuation forces.

SUMMARY OF THE INVENTION

A linear pressure switch apparatus is described that comprises a first elongate conductor plate that has a pair of opposed faces, a second elongate conductor plate that has a pair of opposed faces and at least one insulative strip that separates and electrically isolates the first conductor plate and the second conductor plate. A jacket encases the structure of the conductors and the at least one insulative strip. The jacketed structure provides an at least water resistant barrier. An attachment mechanism is adapted to fix the jacketed structure in position on an external structure.

A linear pressure switch apparatus is described that comprises a first elongate conductor plate that has opposed terminal end portions, a second elongate conductor plate that has opposed terminal end portions, an insulative strip that separates and electrically isolates the first conductor plate and the second conductor plate. A jacket encases the conductors and the at least one insulative strip and provides a jacketed structure that is at least water resistant barrier. A set of connectors are coupled to the terminal end portions of the conductors that extend through the jacket and are adapted to interface with a mating set of conductors.

A linear pressure switch apparatus is described that comprises a first elongate conductor plate that has opposed terminal end portions, a second elongate conductor plate that has opposed terminal end portions, an insulative strip that separates and electrically isolates the first conductor plate and the second conductor plate. A jacket encases the conductors and the at least one insulative strip and provides a jacketed structure that is at least water resistant barrier. A bias member is positioned between the jacket and the first elongate conductor plate that is a resilient foam. The bias member provides a tactile sensation to the activating of the conductors.

A linear pressure switch array is described that comprises a first elongate conductor plate that has a pair of opposed faces, a second elongate conductor plate that has a pair of opposed faces, a first insulative strip that separates and electrically isolates the first conductor plate and the second conductor plate, a third elongate conductor plate that has a pair of opposed faces, a fourth elongate conductor plate that has a pair of opposed faces, a second insulative strip that separates and electrically isolates the third conductor plate and the fourth conductor plate, a fifth elongate conductor plate that has a pair of opposed faces, a sixth elongate conductor plate that has a pair of opposed faces and a third insulative strip that separates and electrically isolates the fifth conductor plate and the sixth conductor plate. The sensitivity of each pair of conductive plates varies to provide a range of activation signals. A jacket encloses the conductor plates and insulative strips to form a jacketed structure.

BRIEF DESCRIPTION OF THE DRAWINGS

Preferred embodiments of the invention are described below with reference to the drawings, wherein like numerals are used to refer to the same or similar elements.

DETAILED DESCRIPTION

Figure 1:
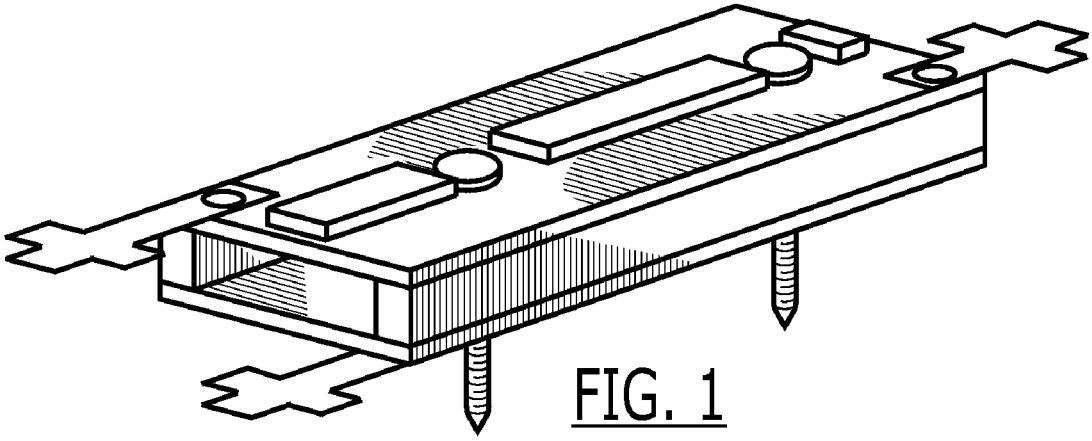
FIG. 1 is a front and side perspective view of a linear pressure switch apparatus constructed in accordance with the present disclosure showing one preferred attachment mechanism.

Referring initially to FIG. 1, linear pressure switch 10 is a parallel conductor continuous length switch that includes a first conductor 12 and a second conductor 14 positioned in spaced relation by insulation 16. Conductors 12 and 14 are conductive plates that preferably have an elongate shape with opposed longitudinal edges 18, opposed terminal end portions with lateral edges 20, an outward directed face 22 and an inward directed face 24. Conductors 12 and 14 can be made of any electrically conductive material, but are preferably made of spring steel. Linear switch 10 is a normally open momentary pressure sensitive switch.

Switch 10 is shown as an in-line switch with a first set of connectors 13 and a second set of connectors 15 that are adapted to interface with mating connectors. Connectors 13 and 15 are shown as standard spade connectors, but it is understood that connectors 13 and 15 can have any structure, angular orientation, positioning or configuration. Connectors 13 and 15 advantageously facilitate the field installation and removal of switch 10 in a circuit.

Insulation 16 has a predetermined thickness that provides an air gap that separates and electrically isolates conductors 12 and 14 in a first position of switch 10. Insulation 16 is preferably a pair of strips of insulation 16 with each strip positioned in proximity to one of longitudinal edges 18. Insulation 16 extends approximately the length of switch 10. Insulation 16 can vary in both lateral width, height and in material to provide a desired degree of switch sensitivity. Insulation 16 is preferably a resilient foam material that separates conductors 12 and 14 in the first position and can be compressed by a force approximately perpendicular to face 22 to make electrical contact between conductors 12 and 14 in a second position. In one preferred embodiment, insulation 16 is 3M—No. 4016 double coated urethane foam tape. The approximate height of the air gap provided by insulation 16 can vary depending upon the desired application, but typically ranges between 0.003 and 0.1875 inches.

Linear switch 10 preferably includes an attachment mechanism 26 that fixes switch 10 in position against an external surface. Attachment mechanism 26 as defined herein is a mechanical device for securely fixing switch 10 to an external structure without the use of adhesives. In this preferred embodiment, attachment mechanism 26 is a set of at least one aperture that is adapted to receive one or more fasteners 28 that extend through switch 10 and into the external structure. Fasteners 28 are preferably threaded screws that can be fabricated from any suitable material such as for example metals, polymers and/or composites that securely attach switch 10 to the external structure.

Figure 2:
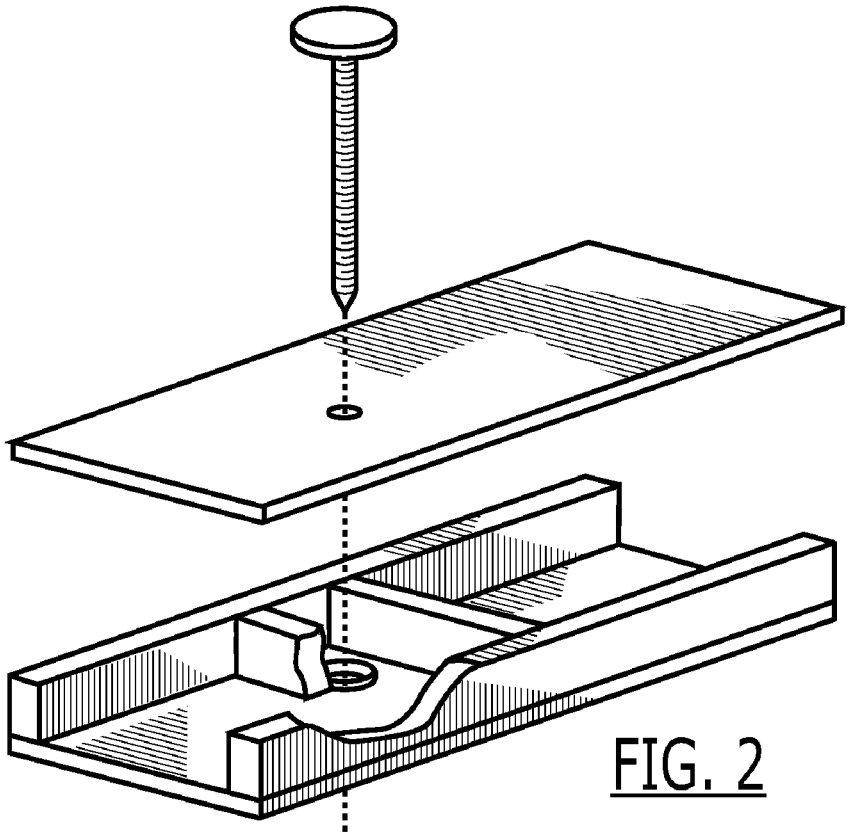
FIG. 2 is an exploded front and side perspective view of the linear switch of FIG. 1 that shows one preferred positioning of the insulation.

As shown in FIG. 2, linear switch 10 defines a set of one of more apertures 30 that receive fasteners 28. Apertures 30 preferably have a non-conductive layer 32 positioned between conductors 12 and 14. Layer 32 preferably functions to provide an at least water resistant seal for switch 10 and can also be selectively employed to provide an electrically insulation barrier between conductors 12 and 14. Layer 32 can include devices such as an O-ring, sleeve or grommet, for example.

In addition, one or more additional insulation members 34 are preferably added in proximity to aperture 30 to provide an insulation barrier between conductors 12 and 14. Insulation members 34 are preferably the same material as insulation strips 16. Insulation members 34 are shown as strips approximately perpendicular to the longitudinally aligned insulation strips 16, but it is understood that insulation 34 can have any shape, material or angular orientation to include a planar circular disc or angular shape that provides the required electrical isolation of conductors 12 and 14 when switch 10 is fixed in position by fastener 28.

It is also understood that apertures 30 can be positioned at any location on switch 10, to include through insulation strips 16, depending upon the intended application. Apertures 30 are preferably positioned approximately along the longitudinal centerline of switch 10 to minimize the number of apertures 30 and fasteners 28 to advantageously reduce the time required for installation and removal of a given switch 10. Alternatively, apertures 30 in proximity to longitudinal edges 18 preserve the continuous activation capability of switch 10. Apertures 30 in proximity to longitudinal edges 18 that extend through insulation strips 16 can selectively include a washer, grommet or sleeve to improve the resistance to water intrusion. Fasteners 28 in applications with apertures 30 in proximity to longitudinal edges 18 can also have heads with reduced dimensions in one or more dimensions so that the heads of fasteners do not extend beyond longitudinal edges 18.

Figure 3:
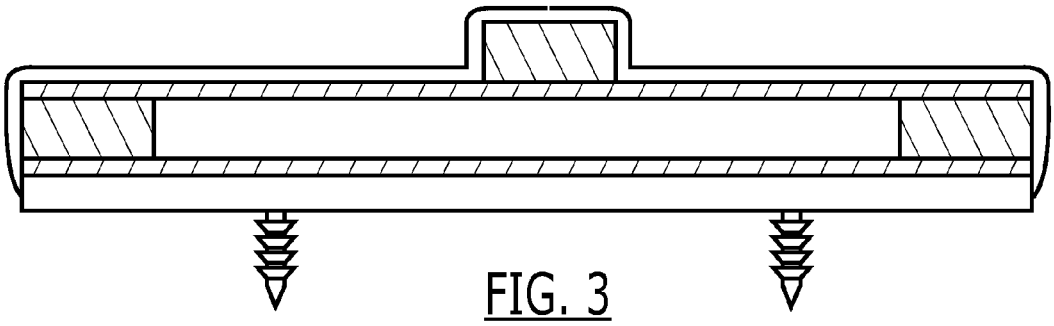
FIG. 3 is frontal view of the linear switch of FIG. 1 with an attachment mechanism that includes a base plate and fasteners.

Referring now to FIG. 3, attachment mechanism 26 can also include a base plate 36. In this preferred embodiment of attachment mechanism 26, base plate 36 has a set of one or more fasteners 28 that can be a monolithically formed or an integrally connected assembly with base plate 36. Fasteners 28 are preferably snap-fit type devices that readily push into and attach with a previously prepared hole in an external surface. As described previously, fasteners 28 can be approximately aligned with the longitudinal centerline or any other position on switch 10. Base plate 36 is attached to outward face 22 of second conductor 14 using known methods such as for example adhesives, heat bonding or fasteners. Switch 10 is encapsulated in an outer covering or jacket 38 to form an at least water resistant jacketed structure. Jacket 38 is preferably a shrink tube, molded, extruded or other type of protective barrier that covers the length of conductors 12 and 14.

Figure 4:
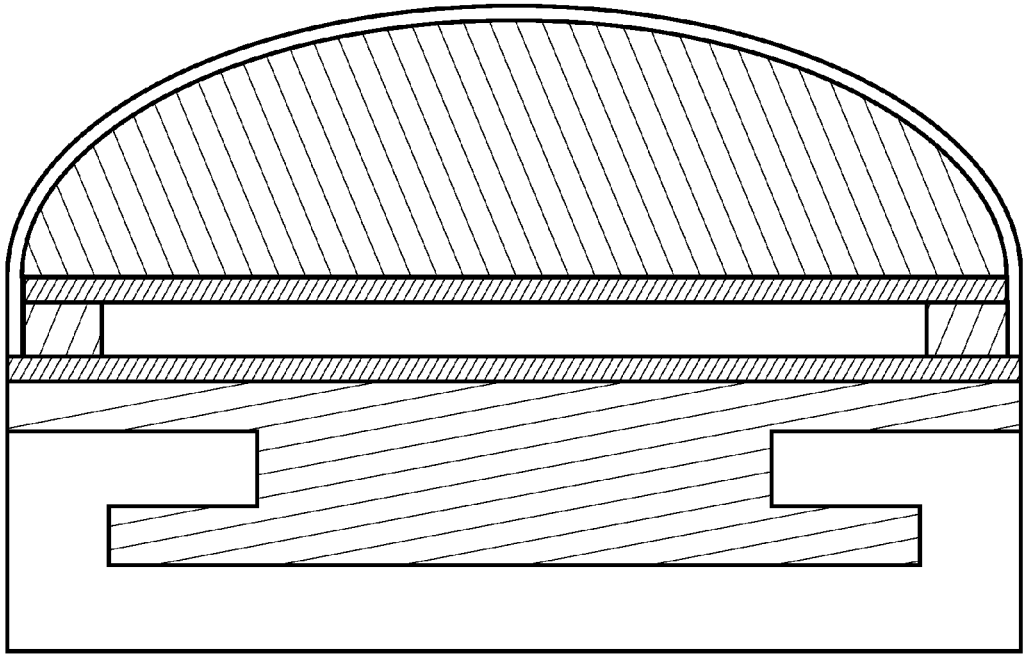
FIG. 4 is frontal view of the linear switch of FIG. 1 with an attachment mechanism that includes a base plate that is adapted to interface with a standard channel.

As shown in FIG. 4, a second embodiment of base plate 36 includes a flange 40 that interfaces with an external structure that is an exemplary standard channel 42. Flange 40 in this preferred embodiment has an inverted "T" shape that extends downward from switch 10 that is configured to correspondingly mate and slidingly engage with a mounting track 43 of channel 42. Different channels 42 vary the vertical position of the mounting track 43 and thereby vary the amount that a given linear switch is recessed into or extends above the outer walls of channel 42. Base plate 36 can be advantageously connected to linear switch apparatus 10 to position the linear switch at the desired elevation relative to channel 42. Channel 42 fixedly connects to another external structure such as a wall or floor and provides structural support for the deflection of first conductor 12 relative to conductor 14 for the activation of switch 10.

Figure 5:
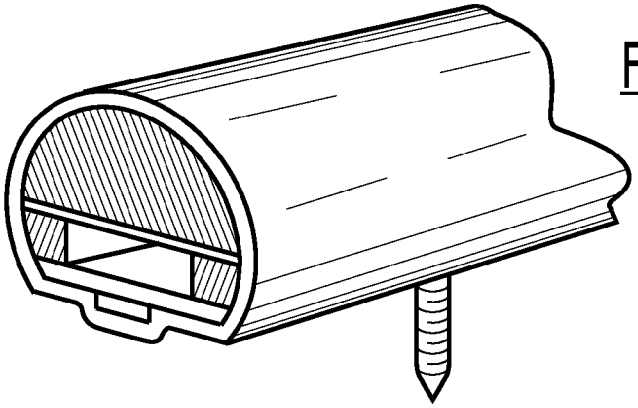
FIG. 5 is front and side perspective view of a second embodiment of the linear switch of FIG. 1 that includes a bias member.

Referring now to FIGS. 4 and 5, switch 10 includes a bias member 44 that is positioned between jacket 38 and face 22 of conductor 12 and preferably extends the full lateral width between longitudinal edges 18. Bias member 44 is preferably a resilient material that is readily compressed with a relatively softer touch than the semi-rigid raised ridge material commonly employed in many applications. Bias member 44 provides an improved sensitivity and ergonomic feel to switch 10 that can be advantageously employed in applications directed towards public use which necessitate the ability of switch 10 to be activated by a broad range of people to include those that are infirm and/or handicapped. Switch 10 can also include an additional lower strip 46 that is attached to face 22 of conductor 14 that can further aid in achieving contact between conductors 12 and 14.

Figure 6:
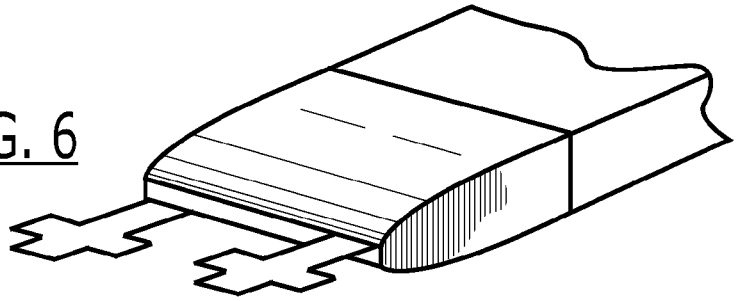
FIG. 6 is a front and side perspective view of a third embodiment of the linear switch of FIG. 1 with a molded end cap.

As shown in FIG. 6, the terminal end portions of switch 10 can also include a cap 48 through which connectors 13 and 15 (not shown) extend. Cap 48 can provide additional structural support to cantilevered connectors 13 and 15 and resistance to water intrusion. Cap 48 is preferably molded, shrunk or an extruded layer that can interface with a mating connector to provide an encapsulated at least water resistant interface.

Figure 7:
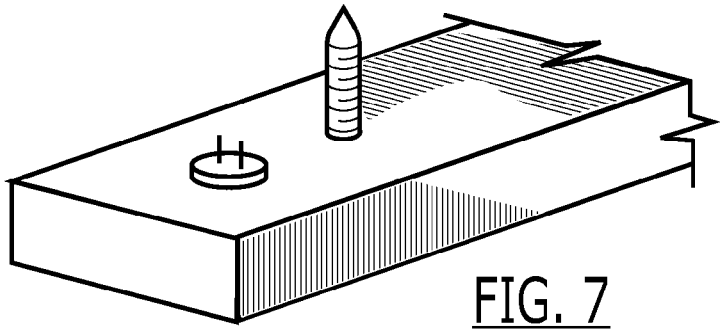
FIG. 7 is a front and side perspective view of a fourth embodiment of the linear switch of FIG. 1 showing a two pin connector on the bottom surface of the switch.

Referring now to FIG. 7, the bottom of switch 10 is shown with fastener 28 extending outwardly. Fastener 28 in this preferred embodiment does not extend through switch 10, but the head of fastener 28 is connected to the bottom of switch 10 using a bonding mechanism such as an adhesive or heat. Cover 38 can also provide a mechanical bonding layer to secure fastener 28 to switch 10. In this preferred embodiment, separate pinned connectors are provided for connectors 13 and 15 (not shown). Pinned connectors provide reliable secure coupling as well as ease of field connection and disconnecting.

Figure 8:
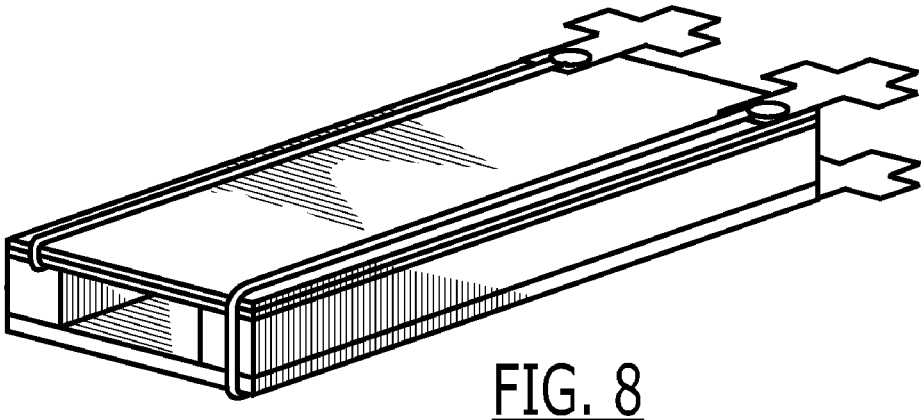
FIG. 8 is a is a front and side perspective view of a sixth embodiment of the linear switch of FIG. 1 showing jumper cables and connectors for the connecting of the switch from a single terminal end portion.

As shown in FIG. 8, switch 10 in this preferred embodiment includes jumpers 50 that are coupled to second set of connectors 15 to provide the connecting of switch 10 from a single terminal end portion of switch 10. This embodiment provides a switch 10 that loops into an external circuit vice as an in-line portion of the external circuit. This provides an advantageous concentration of connectors 13 and 15 on one terminal end portion of switch 10. The four pin switch configuration eases design, installation and repair processes by enabling the coupling to be done at a single point. In this embodiment, second set of connectors 15 are electrically isolated from the adjacent conductor 12 or 14 by a pad or layer 52.

Figure 9:
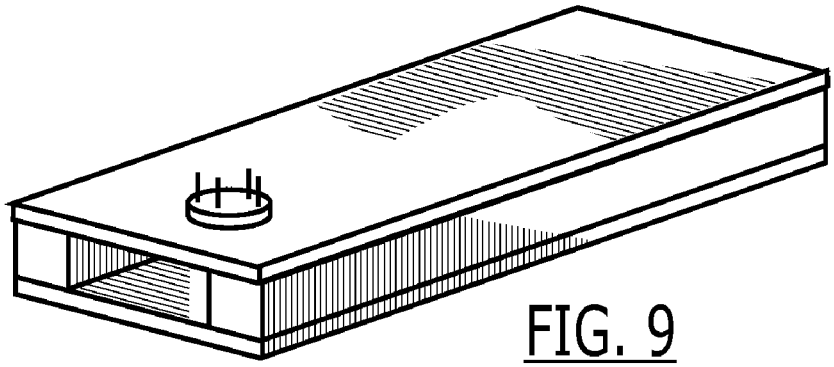
FIG. 9 is a front and side perspective view of the bottom of the linear switch of FIG. 8 showing a four pin connector system.

Referring now to FIG. 9, switch 10 in another preferred embodiment has a single four pin connector 54 that provides for a simple coupling to an external circuit. Connector 54 is coupled with conductors 12 and 14 to provide a single point ease of connection and disconnection with the external circuit.

Figure 10:
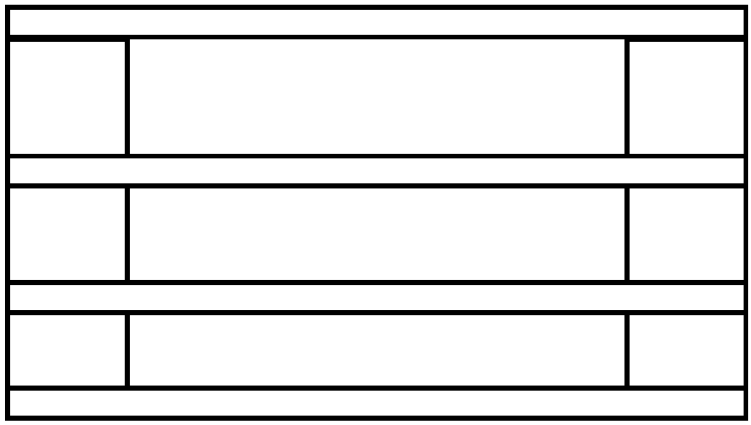
FIG. 10 is a front view of a seventh embodiment of the linear switch of FIG. 1 showing a stacked array of linear switches of varying sensitivities that provide multiple levels of signal actuation.

As shown in FIG. 10, switch 10 in this preferred embodiment is an array of switches 10*a*, 10*b* and 10*c* stacked in parallel with conductors 56, 58, 60 and 62 separated by insulative strips 16. Conductors 56, 58, 60 and 62 can be shared common conductors or alternatively conductors for separate circuits. In this embodiment, strips of insulation 16 reduce the dimensions of the air gap between conductors and thereby increase the sensitivity of each switch from 10*a* to 10*c*. The application of a force in a direction approximately perpendicular to face 22 of conductor 56 displaces each conductor 56, 58, 60 and 62, but that displacement will bring conductors 60 and 62 into contact first due to their reduced air gap. The application of additional force will activate switches 10*b* and 10*a* in sequence. The differing signals from switches 10*a*, 10*b* and 10*c* can be employed to operationally distinguish, for example, contact made by a movable device with a lightly displaceable object such as a chair and a rigid structure such as a wall.

Figure 11:
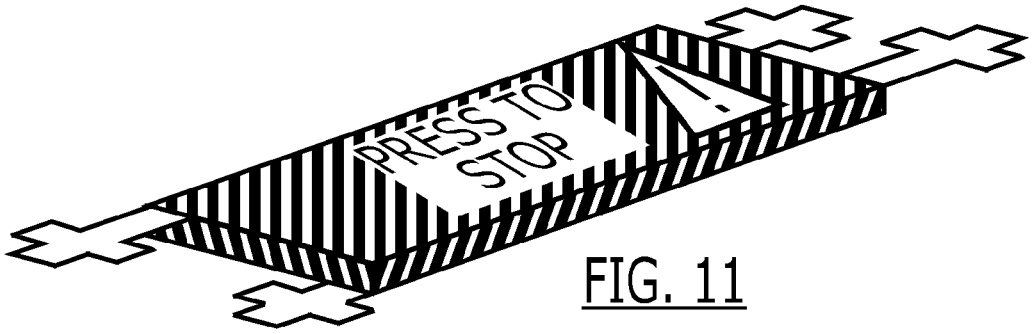
FIG. 11 is a front and side perspective view of the linear switch of FIG. 1 showing external markings to delineate caution and the function of the switch.

Referring now to FIG. 11, switch 10 can include spray on coatings to jacket 38 such as those applied to truck beds to form liners or non-skid, for example. In addition, jacket 38 can have markings that denote warning or hazard through the use of colors, symbols and terms.

Figure 12:
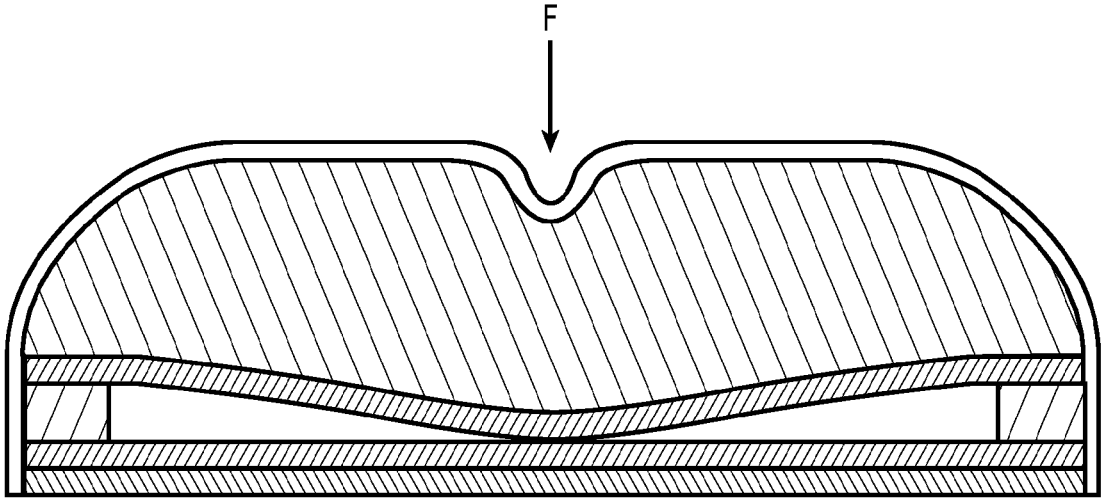
FIG. 12 is a front view of the switch of FIG. 4 in an activated position.

As shown in FIGS. 1, 4 and 12, bias member 44 is positioned between jacket 38 and conductor 12. Bias member 44 is preferably a resilient relatively soft foam that compresses under a force F. Conductors 12 and/or 14 bend under the application of force F that is approximately perpendicular to face 22 of conductor 12 through bias member 44. In response to force F, conductor 12 in this example deflects across the air gap provided by strip insulation 16 into contact with conductor 14. This momentarily activates switch 10 until force F is removed and the resilience of insulation 16 separates conductors 12 and 14. Bias member 44 provides an additional sense of tactile feel during compression and provides an additional bias to the displacement force. Varying the thickness of conductors 12 and 14 as well as the thickness, material and width of strips of insulation 16 and bias member 44 can vary the sensitivity of switch 10 for a given application.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. While the present invention is described in terms of the varying embodiments of attachment mechanisms, connector configurations, soft actuation, and multiple circuit sensitivity for example can be combined with one or more novel features of the other embodiments. The specification and drawings are accordingly to be regarded in an illustrative manner rather than a restrictive sense.

What is claimed is:

1. A linear pressure switch apparatus that comprises:

a first elongate conductor plate that has a pair of opposed faces;

a second elongate conductor plate that has a pair of opposed faces;

at least one insulative strip that separates and electrically isolates the first conductor plate and the second conductor plate;

a jacket that encases the structure of the conductors and the at least one insulative strip, the jacketed structure providing an at least water resistant barrier; and an attachment mechanism that is adapted to fix the jacketed structure in position on an external structure.

2. The linear pressure switch apparatus of claim 1, wherein the attachment mechanism includes a through hole in the jacketed structure that is adapted to receive a fastener for the connection of the switch to an external structure.

3. The linear pressure switch apparatus of claim 1, wherein the attachment mechanism includes a fastener that is connected to one of the conductor plates and extends outwardly approximately perpendicular to the face of the conductor plate.

4. The linear pressure switch apparatus of claim 1, wherein the attachment mechanism includes a base plate that includes a flange that is adapted to interface with a channel.

5. The linear pressure switch apparatus of claim 1, wherein the attachment mechanism includes a base plate that is connected to a fastener.

6. A linear pressure switch apparatus that comprises:

a first elongate conductor plate that has opposed terminal end portions;

a second elongate conductor plate that has opposed terminal end portions;

at least one insulative strip that separates and electrically isolates the first conductor plate and the second conductor plate;

a jacket that encases the conductors and the at least one insulative strip to form a jacketed structure; and a bias member positioned between the jacket and the first elongate conductor plate that is a resilient foam, the bias member providing a tactile sensation to the activating of the conductors.

7. The linear pressure switch of claim 6, wherein the bias member extends between the full lateral width of the longitudinal edges of at least one of the conductors.

8. A linear pressure switch apparatus that comprises:

a first elongate conductor plate that has opposed terminal end portions;

a second elongate conductor plate that has opposed terminal end portions;

at least one resilient insulative strip that separates and electrically isolates the first conductor plate and the second conductor plate in a first position of the insulative strip, the insulative strip switch biased to the first position;

a jacket that encases the conductors and the at least one insulative strip to form a jacketed structure; and a second position of the insulative strip that includes the displacement of at least one of the conductor plates to electrically connect the first conductor plate and the second conductor plate.

9. The linear pressure switch of claim 8, wherein the pressure switch includes a bias member positioned between the jacket and one of the conductor plates.

10. The linear pressure switch of claim 9, wherein the bias member positioned between the jack and one of the conductor plates provides a tactile sensation to the activating of the conductors.

11. The linear pressure switch of claim 8, wherein the pressure switch includes a bias member positioned on the first conductor plate and a strip on the second conductor plate.

12. The linear pressure switch of claim 11, wherein the pressure switch includes a bias member positioned on a first face of the first conductor plate and a strip positioned on a first face of the second conductor plate.

13. The linear pressure switch of claim 2, wherein the through holes include a layer.

14. The linear pressure switch of claim 13, wherein the layer is a non-conductive layer.

15. The linear pressure switch of claim 13, wherein the layer provides an at least water resistant seal.

16. The linear pressure switch of claim 2, wherein an insulation barrier is positioned in proximity to the through hole.

* * * * *